US006112823A

United States Patent [19]

O'Leary

[11] Patent Number: 6,112,823

[45] Date of Patent: Sep. 5, 2000

[54] WASTE FIRE SUPPRESSION CONTROL DEVICE

[76] Inventor: James O'Leary, c/o Samuel Benett Manufacturing Inc., 1105-304 Colborne Street, London, Ontario, Canada, N6B 3N1

[21] Appl. No.: 09/436,648

[22] Filed: Nov. 9, 1999

[51] Int. Cl.[7] ..... A62C 8/00

[52] U.S. Cl. ..... 169/49; 239/60; 239/54

[58] Field of Search ..... 169/54, 56, 57, 169/60, 49, 16; 193/DIG. 2

[56] References Cited

U.S. PATENT DOCUMENTS

| | | |
|---|---|---|
| 1,373,160 | 3/1921 | Barravecchia . |
| 3,912,223 | 10/1975 | Iwata . |
| 4,002,229 | 1/1977 | Washington . |
| 4,646,847 | 3/1987 | Colvin . |
| 4,958,687 | 9/1990 | Nakagawa . |
| 5,562,164 | 10/1996 | McMurray . |

FOREIGN PATENT DOCUMENTS

| | | |
|---|---|---|
| 2666992 | 11/1978 | France . |
| 2719693 | 11/1978 | Germany . |

*Primary Examiner*—Andres Kashnikow
*Assistant Examiner*—Christopher S. Kim

[57] ABSTRACT

The present invention relates to a waste fire suppression control device which is attached to the base of a conventional garbage chute system. The device comprises and incorporates a sequence of two control doors. One door is a main control door which is pivotally mounted at the base of the device and which is biased towards a closed position. The main control door opens only when the weight or force of garbage on the top surface of the door is greater than a pre-determined release force. The other door is a closing plate which is held open during normal operation of the device and closes either automatically in response to elevated temperature or manually. The two control doors together and separately form a barrier to prevent smoke and fire from entering the chute system and to contain smoke and fire within the dumpster area. As well, an integrated conventional sprinkler system floods the device and dumpster below with water.

9 Claims, 4 Drawing Sheets

WASTE FIRE SUPPRESSION CONTROL DEVICE

BACKGROUND OF THE INVENTION

The present invention relates to a waste fire suppression control device which is attached to the base of a conventional garbage chute typically used in high rise buildings. More specifically, the present invention comprises and incorporates a sequence of two control doors which prevent smoke and fire entering the chute system in the event of a fire in the dumpster area. One door is a main control door which is biased towards a closed position separating the exhaust end of the chute from the dumpster below and which opens only in response to a pre-determined release force or weight exerted on the top surface of the door. The other door is a closing plate which during normal operation of the device is held in an open position and which can be deployed either manually or automatically to close the chute. Both doors act as barriers against smoke and fire. The second door ensures that a barrier will be in place in the event that the first door becomes in operable for this purpose. The present invention further integrates a system of conventional sprinklers which flood the device and dumpster below with water. Garbage chutes typically consist of a vertical tube having an intake opening at each floor and are used in most high rise buildings to convey garbage from the upper floors of the building to the basement where it is collected in a dumpster for disposal. In most jurisdictions, fire codes mandate that chute systems have heat activated control doors at the base thereof to prevent smoke and fire from travelling up the chute system in the event of a fire in the dumpster area.

Various control doors for attachment to the discharge end of typical garbage chutes are known. The "A" and "CA" rolling type doors attach to the exhaust end of the garbage chute. Both the "A" and the "CA" designs comprise an inclined door which is held open under normal operating conditions by a fusible link. Each type of door has wheels attached thereto which fit into corresponding tracks which form part of the support frame. When the fusible link fuses at the specified temperature the door rolls shut under the force of gravity.

Another door adapted for use at the bottom of garbage chutes is the "accordion" type door which during normal operations is held open by a spring loaded fusible link assembly. When the link fuses, the door is released and slides along tracks to form a barrier between the dumpster and the chute system. The "accordion" type door is most commonly used in association with chute which discharge directly into a bin or compactor. The fusible links which deploy the prior art doors described above are typically activated at a temperature of about 165 F (74 C).

It should be emphasized that the above mentioned prior art doors are all held open during normal operations. The "A" and "CA" rolling type doors and the "accordion" type door are intended only to provide basic smoke and fire protection and are not designed to perform as a shut-off gate. Because these types of doors are held open during normal operation, the discharge area at the exhaust end of the chute must be kept relatively airtight or under slight negative pressure to minimize the chimney or stack effect. The chimney effect associated with chute systems in high rise buildings tends to draw smoke and toxic fumes, as well as air borne bacteria, up into the chute at a rates up to 40 kph. The smoke, fumes, or contaminated air can then be blown out through the chute intake openings at each floor when a given intake door is opened or stuck open for some other reason.

The "A", "CA", and "accordion" type doors do not operate as a complete seal to prevent smoke and fumes from entering the chute. As well, proper deployment of the prior art doors depends on the tracks on which they slide being free of garbage and not being damaged. These types of doors respond only after the fusible link holding the door in the open position has fused at 165 F. Even if properly deployed the prior art doors do not effectively seal off the chute.

The present invention overcomes the disadvantages associated with the prior art by closing off and sealing the garbage chute during normal operation of the device using a main control door which is biased towards a closed position. The main control door opens to permit garbage to fall into a dumpster positioned below the exhaust opening of the device only when the weight or force of the garbage on the top surface of the door is greater than a pre-determined release force. The main control door automatically returns to its original closed position after opening.

The present invention further overcomes the disadvantages associated with the prior art by means of a second door which acts as a closing plate which can be deployed either manually or automatically to form an additional and effective barrier to prevent smoke and fumes from travelling up the chute. The automatic release of the closing plate is controlled by two independent fusible links each of which is capable of deploying the closing plate. In both the automatic and manual modes, a conventional heat activated sprinkler system operates simultaneously to flood the apparatus with water further ensuring a tight seal at the edges surrounding each door.

By closing and sealing the base of the chute during normal operation the stack effect is minimized and in the event of a fire in the dumpster smoke and fire are contained within the dumpster room. The closing plate and sprinkler system provide additional safety features to prevent smoke and fire from entering the chute system and reaching the upper floors of the building. The closing plate and sprinkler system are automatically activated by conventional fusible links at a temperature of 135 F as opposed to 165 F. By reacting at a lower temperature, the device can begin containing and counteracting fire and smoke more quickly, in turn potentially minimizing costly damage.

SUMMARY OF THE INVENTION

It is an object of the present invention to provide an improved apparatus for attachment to the base of a conventional garbage chute system to prevent smoke and fire from travelling up the chute in the event of a fire in the dumpster positioned below. It is a further object of the present invention to provide an improved apparatus which closes and seals the base of a conventional garbage chute opening only to release garbage into a dumpster positioned below the exhaust opening of the device.

The objects of the present invention are achieved by attaching the device to the base of conventional garbage chute system. More specifically, the objects of the present invention are achieved by two doors which form part of and are integral to operation of the device. The first door is a main control door which is biased towards a closed position and which opens only when a pre-determined release weight or force is exerted on the top surface of the door. The second door is a closing plate which is held in an open position within inclined rails during normal operation of the device, and which can be deployed either automatically by fusible links, or manually.

The objects of the present invention are further achieved by a conventional sprinkler system which floods the device with water sealing the edges of the control doors further helping to prevent smoke and fire from entering the chute. Water from the sprinkler system also has a cooling effect. Excess water is released from the device into the dumpster below reaching the source of the fire.

BRIEF DESCRIPTION OF THE DRAWINGS

In the accompanying drawings which form part of the specification and are to be read in conjunction therewith and in which like reference numerals are used to indicate like parts in the various views.

PREFERRED EMBODIMENT

Figure 1:
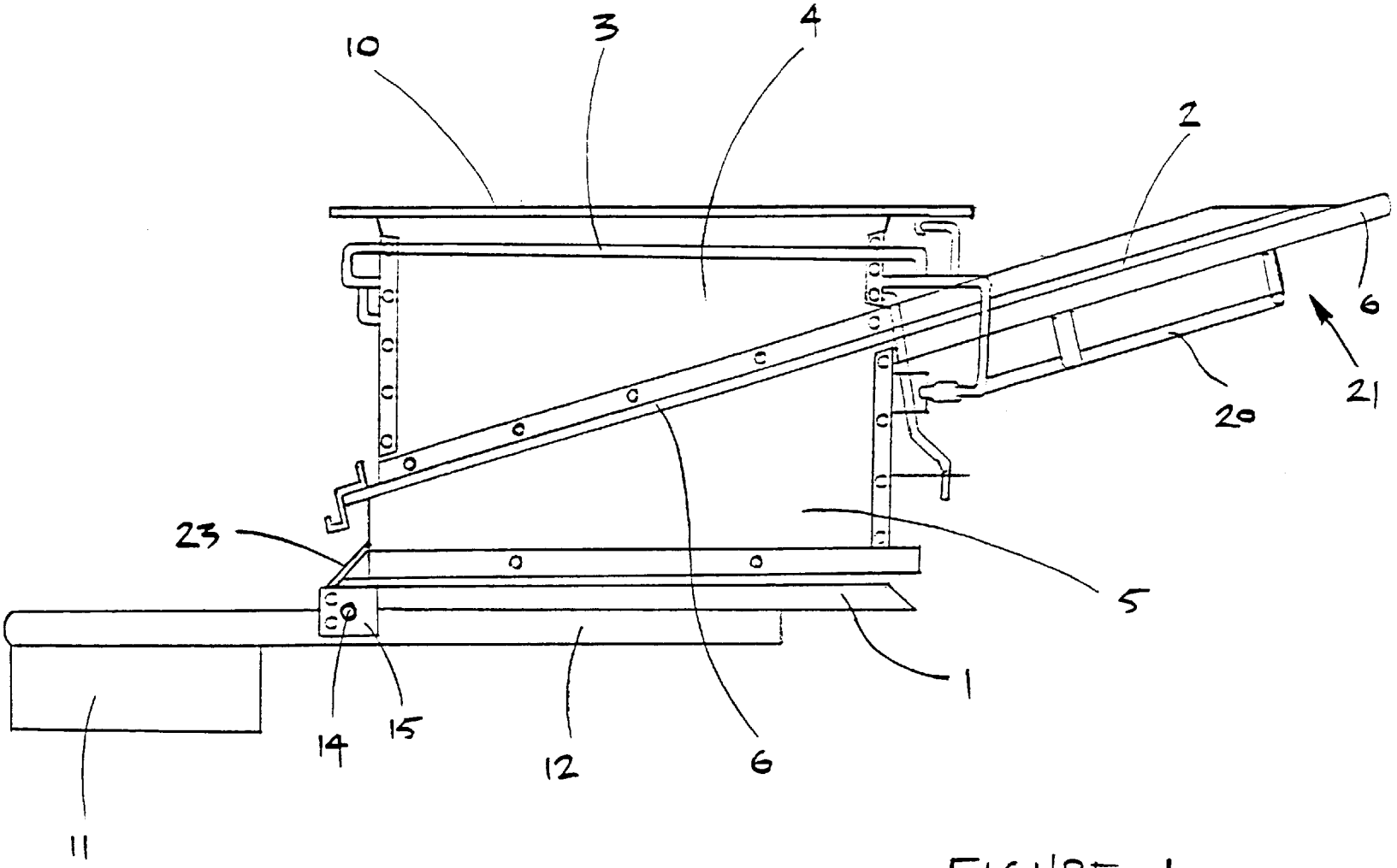
FIG. 1 is a side view of the waste removal control device.

The present invention relates to a waste fire suppression control device [hereinafter WFSCD] which in its preferred form is attached to the base of a conventional garbage chute system typically used in high rise buildings. The body of the device forms an extension at the lower end of the chute system with the exhaust opening of the device being positioned above a conventional dumpster.

The main feature of the WFSCD are two control doors which act together or separately to prevent fire and smoke from travelling up the chute system in the event of a fire in the dumpster. The first door, a main control door 1 is biased towards a closed position opening only when a pre-determined release force is exerted on the top surface of the door. If garbage falling from the upper floors of the building hits the top surface of the main control door 1 with a force greater than the pre-determined release force, the main control door opens allowing the garbage to pass through the exhaust opening of the device into the dumpster below. The second door, a closing plate 2 is held in an open position during normal operation of the device and can be closed either automatically or manually to form an additional barrier cutting off the garbage chute from the dumpster. The present invention is further comprised of a conventional sprinkler system 3 which floods the device with water. The scope of the invention is not limited to chutes used in the disposal of garbage but may also be used at the base of other similar chute systems, for example linen chutes.

The WFSCD is comprised of two segments, the upper chute body 4 and lower chute body 5, each of which is constructed of ⅛" (11 gauge) steel. The upper chute body 4 and the lower chute body 5 are not connected directly but are instead connected to the top and bottom of the closing plate frame 6 respectively to form a continuous enclosed chute. The closing plate frame has integrally formed parallel rails into which the closing plate 2 fits and along which it slides.

The bottom edge of side panels of the upper chute body 4 are oriented at a 45 degree angle with reference to the horizontal. The top edge of the side panels of the lower chute body 5 are also oriented at a 45 degree angle. The lower edges of the upper chute body 4 are angled to support the upper edges of the closing plate frame 6, and the upper edges of the lower chute body 5 are similarly angled to support the lower edges of the closing plate frame 6. Because the edges of the side panels of the upper and lower frames are at complementary 45 degree angles, once each is affixed to the closing plate frame, the closing plate frame is oriented at a 45 degree angle with reference to the horizontal. During normal operation of the device, the closing plate 2 is held in an open position within the rails of the closing plate frame. Once released either manually or automatically, the closing plate slides under its own weight shutting off the passage defined by the upper and lower chute bodies.

The upper chute body 4 has dimensions 24"×24", while the lower chute body 5 has dimensions 26"×26". The purpose of the increased dimensions of the lower chute body is to keep the rails of the closing plate frame free of obstructions and debris that may splash onto the rails. The additional width surrounding the periphery of the entrance into the lower chute body 5 prevents falling garbage from coming in contact with the rails along which the closing plate 2 slides. A retaining support frame 10 formed around the top edges of the upper chute body 4 connects the WFSCD to the garbage chute system leading down from the upper floors of the building.

The main control door 1 of the WFSCD is biased towards a closed position forming a barrier between the dumpster and the garbage chute during normal operation of the device. A counter balance weight 11 at the opposing end of the chassis 12 which supports the main control door 1 biases the main control door towards said closed position. By separating the chute system from the dumpster in this manner, the chimney or stack effect typically associated with high-rise buildings which draws smoke as well as air borne contaminants upwards into the chute is minimized. The main control door opens only when enough downward force is applied to its top surface to overcome a pre-determined release force created by the counter balance weight 11 and a releasable locking mechanism associated with the hinge assembly 14. If the pre-determined release force is achieved, the chassis pivots at the hinge assembly swinging the main control door open permitting the garbage to fall into the dumpster below. Once the garbage is released from the device the counter balance weight 11 automatically returns the main control door to the original closed position.

The main control door 1 is preferably comprised of three steel plates. The base plate of the main control door is attached directly to the chassis 12 and is comprised of ¼" steel plate, the three outer edges of which are turned downwards at substantially 45 degrees. The fourth edge of the base plate, above the hinge assembly, is turned downwards at 90 degrees. Affixed to the top surface of the base plate is steel plate an ⅛" in thickness and affixed to the top of it another steel plate a ¼" in thickness. The ⅛" plate has a rectangular extension which stands substantially vertical between the hinge assembly and exhaust opening of the device when the main control door is in the open position, acting as a barrier preventing falling garbage from coming in contact with the hinge assembly. The ⅛" and ¼" steel plates affixed to the base plate are smaller in dimensions than the base plate in order to fit snugly inside the exhaust opening of the lower chute body 5 forming a tight seal when the main control door is closed. There is also a cutting action created by the smaller plates during the closing of the main control door, severing any garage stuck to main control door or to the bottom edges of the lower chute body might otherwise obstruct a complete seal.

The main control door 1 rests on top of one end of a rectangular chassis 12 which includes two stiffener members which run diagonally to opposite corners of the chassis assembly. The stiffener members cross at the fulcrum, directly below where the hinge assembly 14 connects the chassis 12 to the lower chute body 5. As well as supporting the main control door, the chassis 12 also supports the counter balance weight 11, which is welded to the chassis at the end opposite to the main control door. A steel plate encloses the chassis assembly. The resulting structure provides support to the edges of the main control door preventing the horizontal surface of the main control door from bending, thereby maintaining a complete seal between the main control door and the exhaust opening of the device. The counter balance weight 11, which is heavier than the main control door 1 biases the main control door towards the closed position and automatically returns the main control door to said closed position after opening.

The hinge assembly 14 consists of three adjacent sections of hollow steel pipe. The centre section of steel pipe is welded to each of the longitudinal bars comprising the chassis, while the outer sections of steel pipe are welded to the lower chute body 5. A shaft running through the hollow steel pipes is held solid at the centre section allowing the shaft to act as a torsion bar. The shaft running through the three hollow steel pipes is also fixedly attached at each end to an end housing 15. The outer sections of steel pipe rotate with reference to the fixedly held end housings 15 and centre steel pipe. The rotation of the outer sections of steel pipe causes the chassis to pivot and the main control door to open.

The hinge assembly 14 has associated with it two identical independent locking mechanisms which releasably lock the main control door 1 in the closed position. In order for the door to open, the weight or force exerted on the top surface of the main control door 1 must be sufficient enough to cause each releasable locking mechanism to disengage. The two releasable locking mechanisms act independently, each being welded to one of the outer steel pipes described above which pivot the chassis. Each releasable locking mechanism is housed within a cylindrical pipe closed at one end and is comprised of a steel pin which rests against a spring which in turn presses against a steel ball bearing. Each ball bearing fits into a corresponding socket machined into the surface of its respective end housing locking the main control door in the closed position. To open the main control door, weight or force applied to the top surface of the main control door causes each ball bearing to exert a force on the spring it engages causing the spring to compress. The compression of the spring allows each ball bearing to be released from the corresponding socket it engages. While each locking mechanism acts independently, because they are in alignment they act in unison to releasably lock the main control door in the closed position.

An aperture in the cylindrical pipe housing the pin, spring, and ball bearing is used to deliver grease to the constituent parts comprising the locking mechanism. Under normal operating conditions the grease facilitates the operation of the locking mechanism. In the event of fire, however, the grease lubricating the locking mechanism melts away forcing the ball bearing to remain in locked in its corresponding socket preventing the main control door 1 from opening.

The force created by the two independent locking mechanisms and the counter balance weight 11 contribute to the pre-determined release force which must be overcome in order to open the main control door 1. Garbage travelling down the chute system makes contact with the top surface of the main control door exerting a certain force depending on the mass and acceleration of the object. If the force exerted on the top surface of the main control door is greater than the pre-determined release force the door swings open, pivoting at the hinge assembly, permitting the garbage to fall into the dumpster below. If the garbage does not hit the main control door with sufficient force to open it, the garbage sits on the top surface of the main control door until additional objects generate a combined weight or force greater than the pre-determined release force.

The closing plate 2 which is constructed of ¼" steel, fits into the rails of the closing plate frame 6 and slides on six ⅜" steel ball bearings. The closing plate acts together with the main control or independently if the main control door is obstructed or inoperative for some reason to form barrier to prevent the spread of smoke and fire up the chute system. Under normal operating conditions, the closing plate is held open by a latch 21 pivotally connected to the top end of the release arm 20, which abuts an abutment plate affixed to the bottom surface of the closing plate near its top edge. The closing plate is held open so long as the release arm is secured at its base by suitably adapted attachment means, the effect of which is to lock the pivotal connection between the release arm and the latch. The disengagement of the release arm from said attachment means at the base thereof causes the latch to pivot with reference to the release arm and disengage from the abutment plate affixed to the closing plate. The closing plate then slides under its own weight along the inside flat surface of the parallel closing plate rails, dividing the upper and lower chute bodies in turn separating the chute system from the dumpster. Structurally, in addition to connecting the upper and lower chute body and supporting the closing plate 2, the closing plate frame 6 also supports the release arm 20, and the water over flow flap 23 which is later described.

Figure 2:
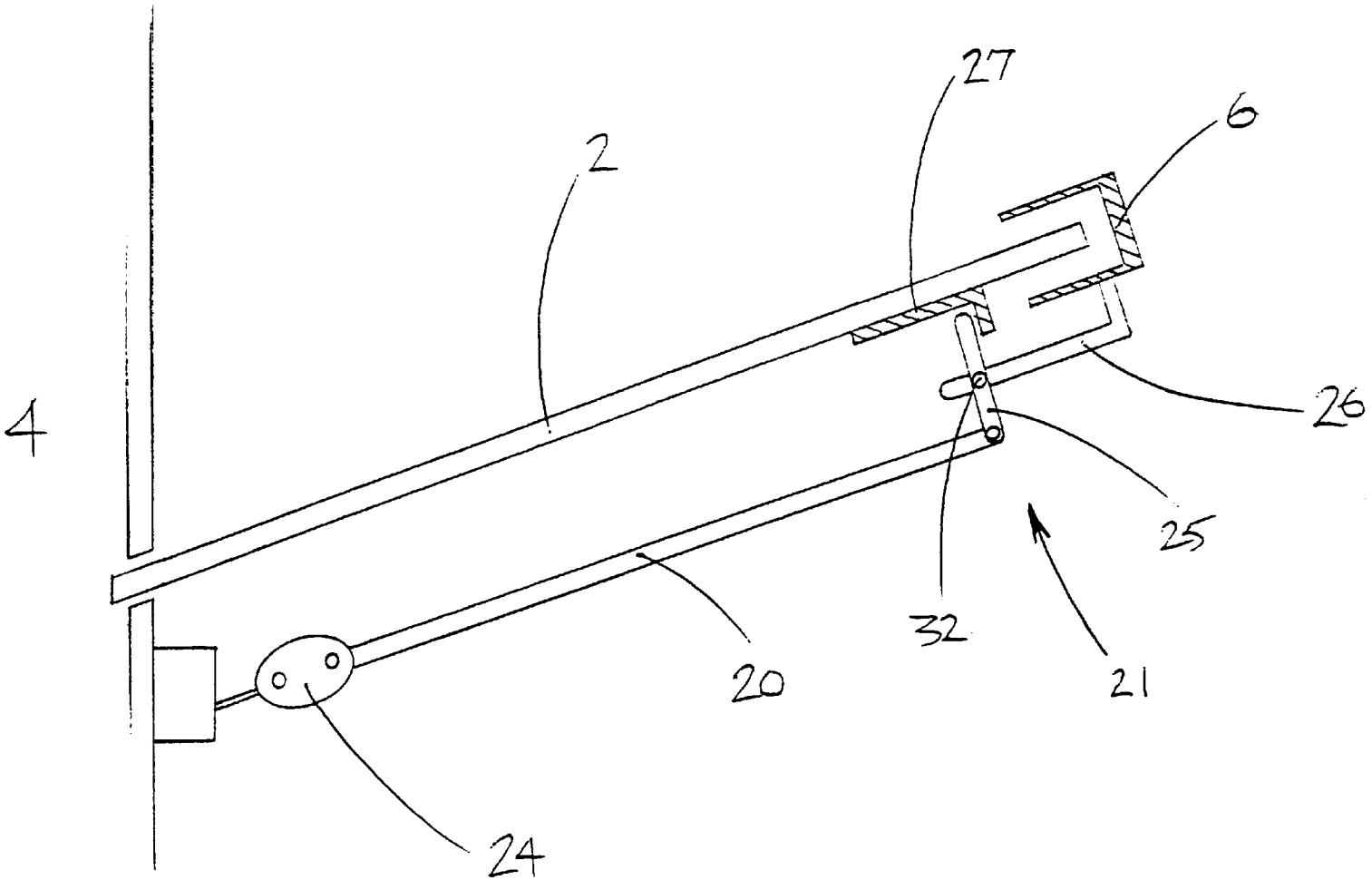
FIG. 2 is a partly sectional schematic view of the latch mechanism for the closing plate.
Figure 3:
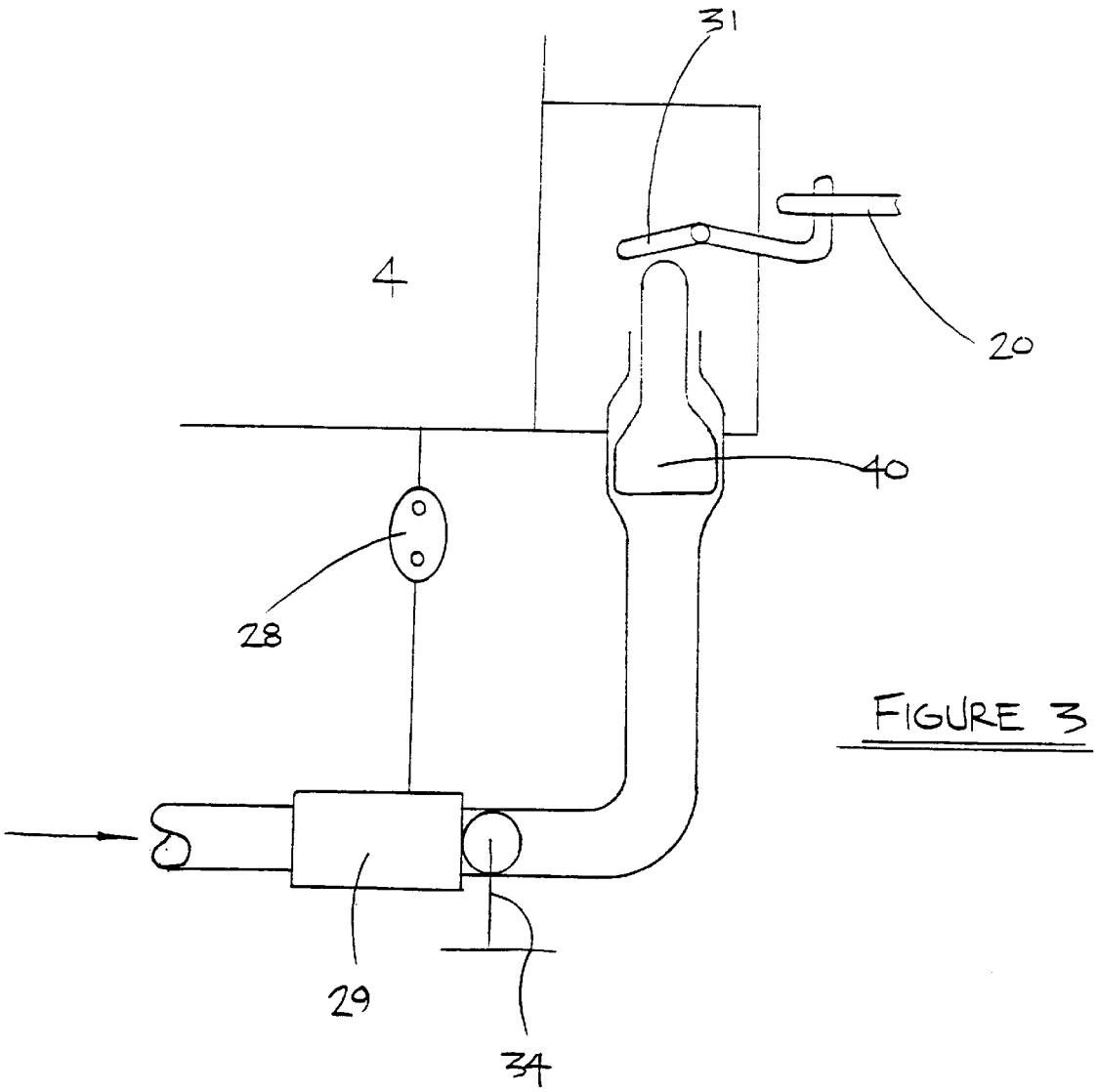
FIG. 3 is a schematic illustration of the operation of the latch mechanism by means of the water valve and piston.

The automatic release of the closing plate is controlled by two independent release mechanisms each capable of deploying the closing plate. Each automatic release mechanism is initiated by a fusible link activated at a temperature of about 135 F. Fusible links having different melting temperatures may be used without deviating from the scope or spirit of the invention. A first fusible link 24 attached directly to the base of the release arm 20 when it melts detaches the base of the release arm from the body of the device causing the latch 21 at the top of the release arm and the abutment plate affixed to the closing plate. The latch 21 comprises a simple pivoting linkage 25 attached to the closing plate frame 6 by means of a flange 26. When the fusible link 24 melts, the release arm 20 detaches from the chute body 4 and permits the linkage 25 to pivot about pin 32 releasing it from behind the abutment plate 27 and deploying the closing plate 2. This is shown in FIG. 2 to disengage, which in turn deploys the closing plate. A second fusible link 28 controls a water control valve 29 which admits water at city pressure to a piston 40 whose movement causes the base of the release arm 20 to unhook from engagement means 31 associated with the piston causing the latch at the top of the release arm to disengage the abutment plate. Referring to FIG. 3, the fusible link 28 melts and operates the water control valve 29 then piston 30 moves forwardly to disengage the engagement means 31 from the release arm 20 to deploy the closing plate. The manual operation of the closing plate is controlled by a water control valve 34 which operates the same piston involved with the automatic closure of the closing plate by bypassing the fusible link which governs the automatic release of the closing plate. The specific operation of each release method is hereinafter set out in greater detail.

The fusible link which controls the first method of automatically releasing the closing plate operates by disengaging the mechanical latch pivotally attached to the top of the release arm which abuts an abutment plate affixed to the base of the closing plate. The fusible link is attached directly to the base of the release arm. Once the specified temperature is reached, the release arm which holds open the closing plate under normal operations by preventing the latch from pivoting is released, which permits the latch to pivot and disengage the abutment plate affixed to the closing plate. The closing plate slides shut under its own weight.

The fusible link involved in the second method of automatically releasing the closing plate is fixed to a water control valve. When the fusible link melts at the specified temperature a ball valve opens admitting water at city pressure. The resulting water pressure activates a piston which pushes against a plate affixed to one end of a pivoting arm. The opposite end of the pivoting arm engages the base of the release arm and has suitable attachment means for unhooking said release arm in response the pivoting action created by the piston. As water pushes the plate affixed to the pivoting arm, the opposing end of the pivoting arm moves in the opposite direction relative to the piston. The pivoting action unhooks the base of the release arm from the attachment means associated with the pivoting arm allowing the latch at the top of the release arm to pivot, in turn releasing the closing plate. The closing plate is deployed even though the first fusible link described above which is also independently capable of deploying the closing plate is still intact. Although the fusible link controlling each automatic release mechanism is specified to melt at 135 F, since each is positioned at a different location, one may melt before the other depending on where the heat surrounding the device is most intense.

Figure 4:
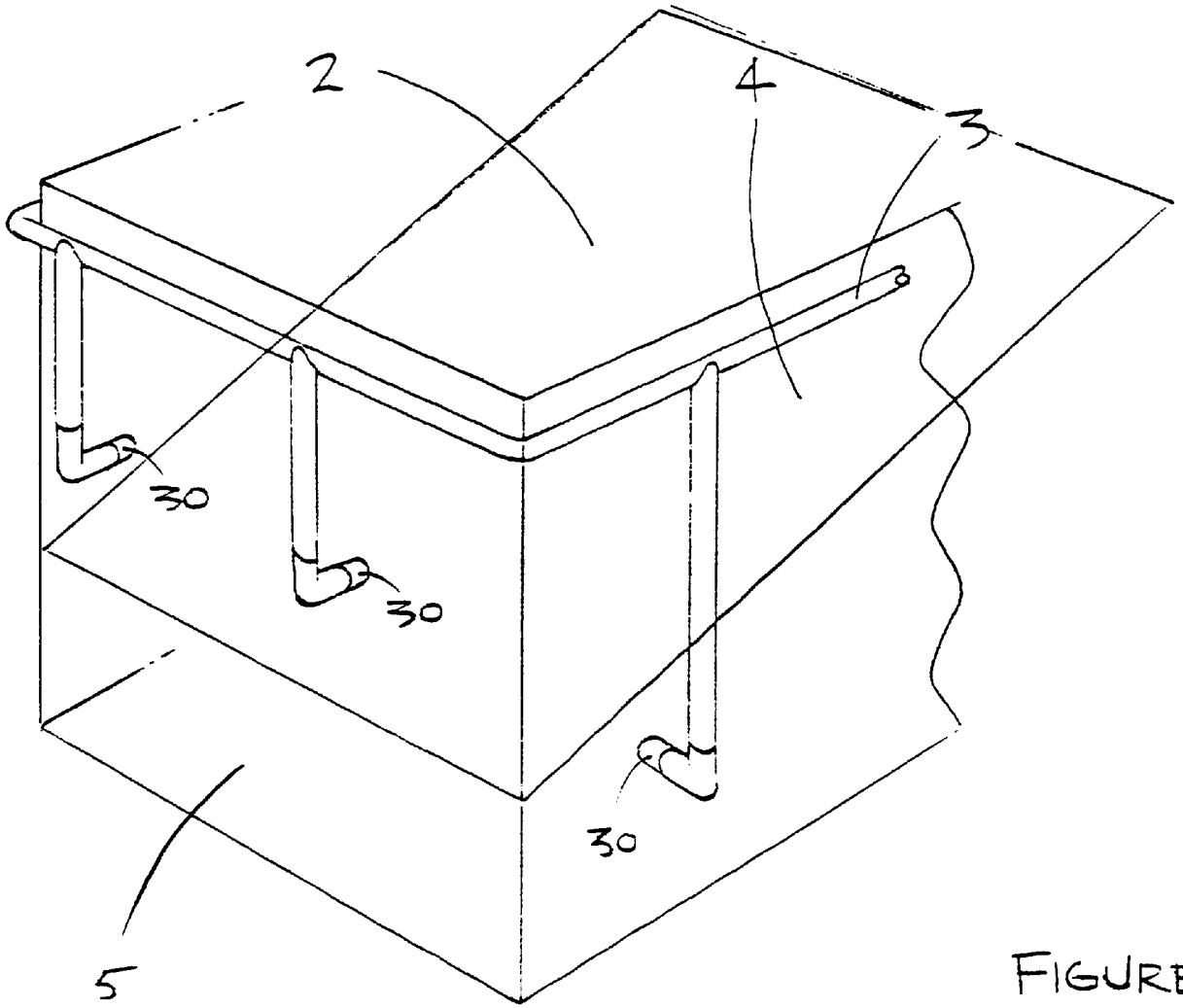
FIG. 4 is a perspective partly sectional view of the chute body illustrating the location of the water jets.

The fusible link controlling the water control valve also simultaneously activates a sprinkler system 3. Some of the water passing the through the valve is diverted to the pipes of the sprinkler system leading to the water jets 30. Each 10 water jet protrudes through a corresponding orifice in the body of the waste removal control device to flood it with water. As shown in FIG. 4 (t) two of the water jets spray above the closing plate, the spray directed towards the upper surface of the closing plate. The third floods the lower chute body, the spray directed towards the under surface of the closing plate.

The sprinkler system 3 provides an additional protective feature of the waste removal control device as the water pools around the side clearances of the closing plate and around the edges of the main control door 1 forming a water seal preventing smoke and fumes from travelling up the chute system. The water further has a cooling effect. Even in the unlikely event that both the main control door 1 and the closing plate 2 are held partially open by some obstruction, the water flooding around the obstruction helps maintain a water barrier against smoke and fumes.

The manual operation of the closing plate is similar to the second automatic release mechanism for deploying the closing plate described above. The closing plate can be manually released by suitably adapting the system using conventional means to bypass the fusible link which controls the operation of the piston and sprinkler system. A manually operated water control valve which bypasses the fusible link when opened permits water to engage the piston deploying the closing plate and activate the sprinkler system using the same apparatus as is involved with the automatic release of the closing plate.

A spring-loaded water over-flow flap 23 is attached to the lower end of the closing plate frame 6 above the hinge assembly 14. Under normal operating conditions it is biased towards a closed position. As water fills the lower chute body via the activation of the sprinkler system either manually or automatically, pressure on the water over-flow flap 23 builds until there is enough force to overcome the force of the spring which normally biases the flap closed. The water released through the flap falls to the dumpster positioned below waste removal control device, reaching the source of the fire and smoke.

From the foregoing, it will be seen that this invention is one well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A waste fire suppression control device for use in association with a garbage chute system in a high-rise building, comprising a housing having an intake opening and an exhaust opening and defining a passage therebetween; an exterior door pivotally mounted on said housing and biased to close against the exhaust opening with a pre-determined force; a closing plate and closing means operable to close said passage with said closing plate in response to a pre-determined temperature and sprinkler means operable to release water within said passage in conjunction with closure of said closing plate.

2. The invention as claimed in claim 1 wherein said closing plate is inclined to move downwardly along downwardly inclined rails from a first latched open position to a second unlatched closed position to thereby close said passage.

3. The invention as claimed in claim 2 wherein said closing means comprises latch means to maintain said closing plate in said open position, said latch means including a fusible link operable to release said latch means in response to a pre-determined temperature.

4. The invention as claimed in claim 3, wherein said latch means further includes valve means hydraulically interconnecting said latch means to a pressurized water supply, said valve means operable to release said latch means in response to a pre-determined temperature.

5. The invention as claimed in claim 4, wherein said latch means further includes valve means hydraulically interconnecting said latch means to a pressurized water supply, said valve means operable manually to release said latch means.

6. The invention as claimed in claims 3, 4 or 5 wherein said pivotally mounted exterior door is biased against said exhaust opening by means of a counter-balanced weight attached to said door.

7. The invention as claimed in claim 6 wherein the closure of said exterior door and said closing plate forms a smoke and fire barrier within said passage.

8. The invention as claimed in claim 7 wherein said waste fire suppression control device is located at the bottom of a chute system and said exterior door is operable to permit garbage within the chute to pass through said passage when the force of falling garbage exceeds said pre-determined force.

9. The invention as claimed in claim 8 wherein said sprinkler means comprises a plurality of water jets able to flood the passage with water operable in response to said pre-determined temperature.

* * * * *